166-274 SR
9/30/80 XR 4,224,992

United States Patent [19]
Comberiati et al.

[11] 4,224,992
[45] Sep. 30, 1980

[54] METHOD FOR ENHANCED OIL RECOVERY

[75] Inventors: Joseph R. Comberiati; Charles D. Locke, both of Morgantown, W. Va.; Krishna I. Kamath, Chicago, Ill.

[73] Assignee: The United States of America as represented by the United States Department of Energy, Washington, D.C.

[21] Appl. No.: 34,804

[22] Filed: Apr. 30, 1979

[51] Int. Cl.[3] ..... E21B 43/20; E21B 43/22
[52] U.S. Cl. ..... 166/273; 166/274
[58] Field of Search ..... 166/268, 263, 266, 273, 166/274, 252

[56] References Cited

U.S. PATENT DOCUMENTS

| | | | |
|---|---|---|---|
| 2,669,307 | 2/1954 | Mulholland et al. | 166/274 |
| 3,084,743 | 4/1963 | West et al. | 166/274 X |
| 3,157,230 | 11/1964 | Connally, Jr. et al. | 166/274 |
| 3,262,498 | 7/1966 | Connally, Jr. et al. | 166/273 |
| 3,295,601 | 1/1967 | Santourian | 166/273 X |
| 3,586,107 | 6/1971 | Parrish | 166/273 |
| 3,620,304 | 11/1971 | Hearn et al. | 166/274 |
| 3,623,552 | 11/1971 | Vairogs | 166/274 |

*Primary Examiner*—Stephen J. Novosad
*Attorney, Agent, or Firm*—James E. Denny; Stephen D. Hamel; Earl L. Larcher

[57] ABSTRACT

The present invention is directed to an improved method for enhanced recovery of oil from relatively "cold" reservoirs by carbon dioxide flooding. In oil reservoirs at a temperature less than the critical temperature of 87.7° F. and at a pore pressure greater than the saturation pressure of carbon dioxide at the temperature of the reservoir, the carbon dioxide remains in the liquid state which does not satisfactorily mix with the oil. However, applicants have found that carbon dioxide can be vaporized in situ in the reservoir by selectively reducing the pore pressure in the reservoir to a value less than the particular saturated vapor pressure so as to greatly enhance the mixing of the carbon dioxide with the oil.

7 Claims, 2 Drawing Figures

METHOD FOR ENHANCED OIL RECOVERY

BACKGROUND OF THE INVENTION

The recovery of oil from subterranean oil-bearing strata is accomplished by employing several techniques that are initiated by primary recovery and often followed by various secondary and tertiary recovery procedures that are commonly referred to as enhanced oil recovery techniques. Primary oil recovery is usually achieved by penetrating the oil-bearing earth formation with a plurality of wells and recovering the oil from these wells by utilizing the natural, i.e., pore, pressure and in the subterranean earth strata. In most applicatons, especially where the oil is of relatively high viscosity or is in a "tight" formation, as little as about 5 percent of the oil is normally recovered by primary techniques.

In order to recover oil beyond the percentage attainable by primary recovery, several enhanced oil-recovering techniques have been developed and successfully utilized. For example, hydraulic fracturing, water flooding, thermal flooding, and chemical flooding have proven to be highly successful for recovering substantial oil from oil-bearing strata after completing primary recovery operations.

One of the more promising enhanced oil-recovery techniques involves the use of carbon dioxide ($CO_2$) for flooding. In this process, carbon dioxide is pumped into a well where the earth formation is usually of a sufficiently high temperature to ensure that the carbon dioxide is in a gaseous state with the gas being readily absorbed by the oil to swell the oil and decrease the viscosity thereof. The swelling and lowering the viscosity of the oil greatly increase the mobility of the oil to facilitate its recovery from the oil-bearing strata. In some cases, the oil may be partially vaporized by the carbon dioxide allowing it to be miscibly displaced by the carbon dioxide.

Oil reservoirs throughout North America vary considerably in temperatures and pressures, with the temperatures ranging from a low of about 60° F. in some of the shallower reservoirs to well over 200° F. in other reservoirs. Similarly, the pore pressure varies in the range of from about several hundred psia to several thousand psia across the continent. In roughly calculating the temperature and pressure of a reservoir the standard generalized procedure is to provide an increase in temperature of about 0.02° F. per foot of depth and a pore pressure increase of about 0.05 psi per fot of depth. The maximum stress or pressure that the formation at any given depth can withstand without suffering permanent damage is roughly equal to the "overburden" pressure, normally estimated at 1 psi per foot. The overburden pressure is also the maximum injection pressure that can be used in flooding operations. The fact that oil reservoirs vary considerably in temperature and pressure presents a variety of problems to the use of carbon dioxide in enhanced oil recovery procedures. Carbon dioxide is a non-polar chemical substance which has a critical temperature of 87.7° F. and a critical pressure of 1,071 psia. Thus, in any oil reservoir where the reservoir temperature is less than 87.7° F., the injected carbon dioxide utilized in the enhanced oil recovery will remain as a liquid when the pore pressure of the reservoir is above the cricitcal pressure. If the temperature is above the critical temperature of 87.7° F., the carbon dioxide will be a gas regardless of the pore pressure. Consequently, in reservoirs where the carbon dioxide remains a liquid, the displacement and mixing of the carbon dioxide with the oil are achieved by a mixing of the liquids which at best provides only marginal enhanced recovery. Several major oil reservoirs in Canada and the United States, especially those in the Appalachian region, are at temperatures less than the critical temperature of carbon dioxide. Carbon dioxide flooding of these reservoirs would involve injection pressures greater than the saturated vapor pressure of carbon dioxide at the particular temperature of the reservoir, thus resulting in the injected carbon dioxide being in theliquid state.

A general drawback of the carbon dioxide in flooding process is that the liquid or gaseous carbon dioxide is of relatively high mobility with respect to oil, so as to have a tendency to "finger" through the oil-bearing strata towards the production well at such a rate that it has insufficient contact with the oil to provide adequate enhancement in oil recovery. Also, once the carbon dioxide reaches the production well, the enhanced oil-recovery process is essentially terminated since the carbon dioxide will tend to flow through the paths established by the "fingers" and bypass the surrounding oil-bearing strata.

SUMMARY OF THE INVENTION

It is a primary aim or goal of the present invention to provide an improved method of enhanced oil recovery from oil-bearing strata wherein the temperature of the strata is less than the critical temperature of carbon dioxide (87.7° F.) and wherein the operating injection pressure is expected to be at a value greater than the saturated vapor pressure of carbon dioxide at the particular temperature of the reservoir. As pointed out above, carbon dioxide has a saturated vapor pressure of 1,071 psia at a critical temperature of 87.7° F. The goal of the present invention is achieved by employing a novel method wherein the carbon dioxide may be used for flooding oil reservoirs at relatively low temperatures such as encountered in the Appalachian area in such a manner that the above and other problems associated with liquid carbon dioxide flooding are obviated or substantially minimized. The method of the present invention is practiced by injecting liquid carbon dioxide into one or more injection wells of typical injection-well, production-well arrangement and then pumping down, i.e., reducing the pressure in the oil-bearing strata between the injection well and the production well to a value less than the saturation pressure of the carbon dioxide at the temperature encountered in the reservoir so as to effect vaporization of the carbon dioxide. After the carbon dioxide has thoroughly mixed with the oil, water or some other driving fluid is injected to provide the energy to move the oil to the producing wells. If, during the carbon dioxide injection phase, liquid and vapor carbon dioxide phases are present, the mixing of the carbon dioxide with the oil is at least about two orders greater than achievable in a liquid phase system. As a further comparison, mixing in a gas/gas system is about four orders better than a liquid/liquid system. Thus, by utilizing the method of the present invention the oil recovery in such "cold" reservoirs is significantly increased over that obtainable by employing the carbon dioxide flooding techniques as conventionally utilized.

Other and further objects of the invention will be obvious upon an understanding of the illustrative method about to be described or will be indicated in the appended claims, and various advantages not referred to herein will occur to one skilled in the art upon employment of the invention in practice.

An embodiment of the present method has been chosen for the purpose of illustration and description. The embodiment illustrated is not intended to be exhaustive or to limit the invention to the precise form or method steps disclosed. It is chosen and described in order to best explain the principles of the invention and their application in practical use to thereby enable others skilled in the art to est utilize the invention in various embodiments and modifications of the method steps as are best adapted to the particular use contemplated.

DETAILED DESCRIPTION OF THE INVENTION

Figure 1:
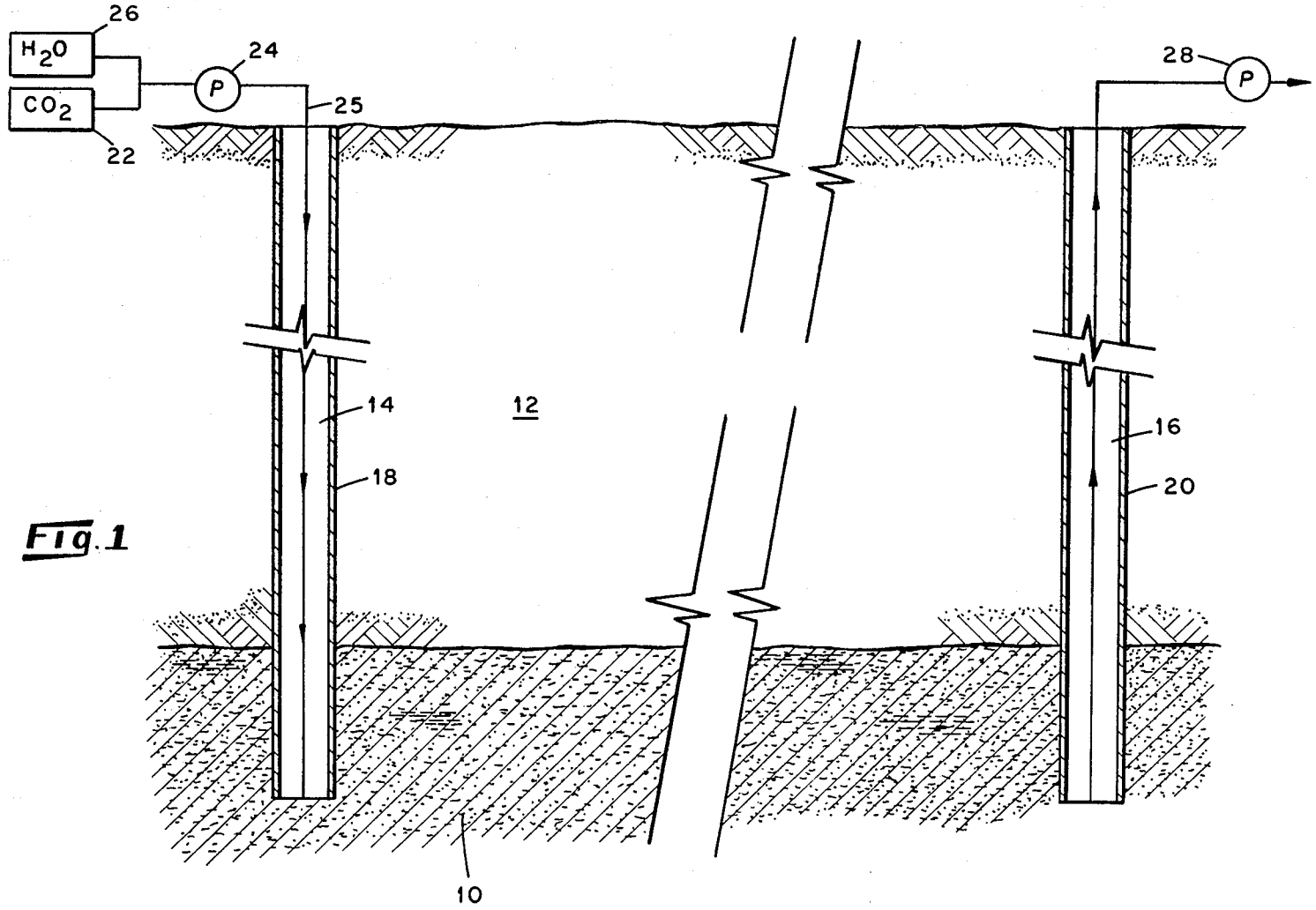
FIG. 1 is a somewhat schematic view generally illustrating a subterranean oil reservoir wherein the oil-bearing strata is penetrated by spaced-apart wells indicative of the injection and production wells conventionally employed in oil reservoirs.

As briefly described above, the present invention is directed to a method of utilizing carbon dioxide flooding techniques in an oil reservoir wherein the temperature is less than the critical temperature of carbon dioxide and wherein the pressure is above the saturated vapor pressure of carbon dioxide at the particular temperature of the oil reservoir. Such a reservoir is typified by FIG. 1 wherein the subterranean oil-bearing strata 10 which underlies overburden 12 is penetrated in the usual manner by a plurality of bore holes or wells 14 and 16 which are spaced apart from one another a selected distance depending upon the particular terrain and reservoir properties. These wells 14 and 16 may be provided with casings 18 and 20, respectively, to ensure the integrity of the bore holes during the recovery of oil from the oil reservoir.

In accordance with the present invention liquid carbon dioxide from a source generally indicated at 22 is pumped by a suitable pumping mechanism 24 through conduit 25 into the oil-bearing strata 10 via well 14. The quantity of carbon dioxide utilized for the carbon dioxide flood is usually about 5 to 15 percent of the pore volume of the strata 10. After injecting the desired amount of carbon dioxide a quantity of water or other driving fluid from source 25 is injected into the well bore 14 to act as a "pusher" to cause further penetration of the carbon dioxide into the oil-bearing strata 10. Upon completing the water injection step which utilizes a quantity of water in the range of about 10 to 20 percent of the pore volume of the strata 10, the injection well 14 is closed or "shut-in". The carbon dioxide in the oil-bearing strata surrounding well 14 migrates through the oil-bearing strata toward well 16 as a liquid. To enhance the mixing of the carbon dioxide with the oil in the oil-bearing strata in this "cold" reservoir, well bore 16 is equipped with a suitable high volume pumping mechanism generally shown at 28, to enable the well bore 16 to be "pumped down" for decreasing the pore pressure in the oil-bearing strata between wells 14 and 16. Except for a small portion of the strata nearest to well 14, the pressure in the oil-bearing strata can be reduced to a value less than the saturated vapor pressure of the carbon dioxide at the particular temperature of the reservoir. Preferably, the pressure in the strata 10 is reduced to a level in a range of about 900 to 500 psia, i.e., about 100 tpo 200 psi below the saturated vapor pressure of the carbon dioxide at the particular temperature for advantageous reasons described in detail below.

With the pressure in the oil-bearing strata 10 reduced to a value less than the saturation pressure of carbon dioxide, the liquid carbon dioxide vaporizes at a location adjacent to well 14 so as to form a liquid-vapor mixture of carbon dioxide which contacts and dissolves in the oil present in the oil-bearing strata between the wells. As pointed out above the mixing of the vaporized carbon dioxide with oil is at least two orders of magnitude greater than that achieved by liquid carbon dioxide alone.

Figure 2:
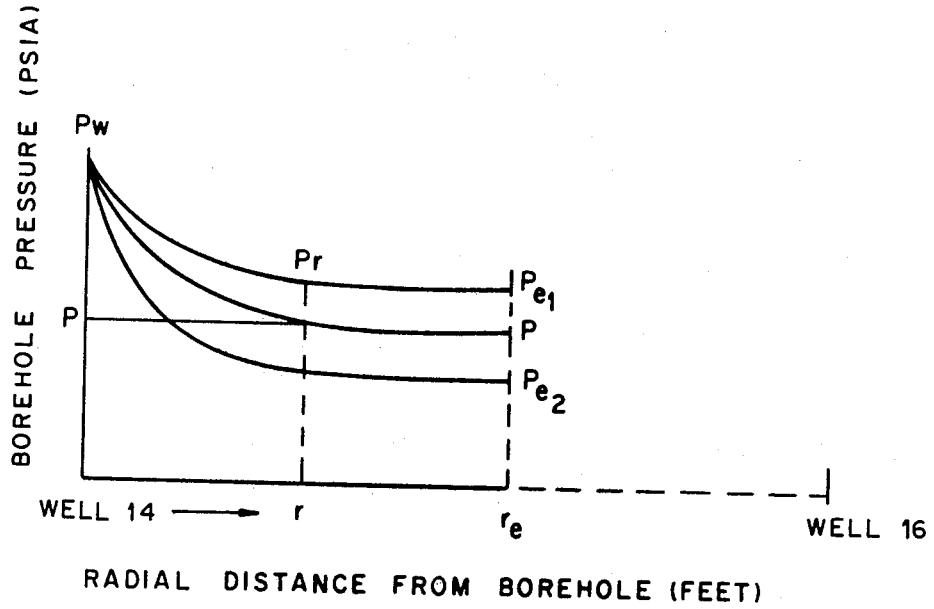
FIG. 2 is a graph with curves illustrative of the pressure distribution over a selected distance in oil-bearing strata such as typified in FIG. 1 and illustrating the effects the pressure decline in the strata has upon the carbon dioxide at a critical temperature of 87.7° F. when the pressure in the oil-bearing strata is reduced to a value less than 1,071 psia.

In order to generally determine the approximate pressure distribution in the oil-bearing strata between the injection well 14 and the production well 16, as shown in FIG. 2, a formula as expressed by Miles and Stephenson, in AIME, Vol. 127, 1938, p. 204 entitled "Pressure Distribution in Oil and Gas Reservoirs by Membrane Analogy," may be utilized. This formula as set forth below may be utilized to readily determine the pressure distribution along the flowing stream lines radiating from the injection well:

$$P_r = P_w - \frac{P_w - P_e}{\ln \frac{r_e}{r_w}} \cdot \ln \frac{r}{r_w}$$

where $P_w$=Injection pressure (psia)

$P_e$=Pressure at distance $r_e$ (ft) from injection well (psia)

$P_r$=Pressure at a distance r (ft) from injection well (psia)

r=Radial distance from injection well to point where pressure is $P_r$ $r_w$=wellbore radius (ft)

$r_e$="Drainage radius" or distance (ft) from injection well at which the pressure gradient approaches zero, (roughly halfway between injection and production wells.)

In FIG. 2 the pressures at the sandface of the injection well 14 and in the reservoir 10 at some distance $r_e$ from the injection well 14 are respectively indicated by the reference characters $P_w$ and $P_e$. Production well 16 is located at a distance approximately 2 $r_e$ from the injection well 14. The pressure gradient in the bulk of the reservoir 10 is nearly linear with more than 50 percent of the pressure drop occurring at a short distance in the range of about 5 to 15 feet from well 14. The curves $P_wP_{el}$, $P_wP$ and $P_wP_{e2}$ in FIG. 2 are example pressure profiles to illustrate the method of this invention. The saturated vapor pressure (P) of carbon dioxide at the reservoir temperature is assumed to be below 1,071 psia. At a reservoir temperature of 80° F., P has the value of 871 psia.

In utilizing the above formula, the area or region above the isobaric line PP in FIG. 2 denotes pressure conditions in the reservoir at which carbon dioxide will exist only in liquid form. This area increases at lower temperatures (downward shift of line PP) and decreases at higher temperatures. The area below line PP is indicative of pressure conditions at which carbon dioxide would first be in the form of liquid and vapor and thus transform completely to vapor when equilibrium is reached.

The pressure distribution from $r_e$ to the production well 16 will be similar to the curves $P_wP_{e1}$ and $P_wP_{e2}$ but of opposite slop indicating fluid production, not injection. Steep pressure gradients and correspondingly high flow rates are only in the portions of the strata 10 in the immediate vicinity of the injection and production wells. In the major portion of the oil-bearing strata 10 between the wells 14 and 16 the flowrates are relatively small due to a slow pressure decline so as to ensure adequate contact time between the carbon dioxide and the oil for satisfactory mixing thereof.

The space occupiable by the carbon dioxide vapor in the reservoir depends upon the void volume of the oil-bearing strata 10. Pumping or otherwise reducing the pressure in the oil-bearing strata through the producer well may be utilized to remove oil and other fluids from the oil-bearing strata in front of the carbon dioxide flood so as to provide a void volume for receiving the carbon dioxide vapor. With the presence of the carbon dioxide vapor along with the carbon dioxide liquid, the vapor will rapidly expand into the voids and ultimately disperse into the oleic and aqueous phases as minute bubbles for facilitating the mixture of the carbon dioxide with the oil and thereby considerably enhancng the removal of the oil by the carbon dioxide flood over that available if the vapor were not present.

In oil reservoirs which have been previously subjected to water flooding for secondary oil recovery, a variation of the method of the present invention may be practiced to provide adequate pore volume for receiving the in situ-formed carbon dioxide vapor. This variation or modification is practiced by first injecting into the oil-bearing strata through the injection well 14 a sufficient quantity or volume of air, nitrogen, air-carbon dioxide mixture, or natural gas to create a gas saturation of about 5 to 15 percent of the pore volume in the reservoir. It is desirable but not necessary to have a gas saturation sufficiently high to provide a steady-state flow condition within the reservoir. After completing the injection of the gas to provide a sufficient pore volume for the transfer of the carbon dioxide vapor from the liquid phase due to the reduction in the reservoir pressure, the carbon dioxide slug is injected into the injection well to practice the invention in the manner described above.

In the event the reservoir has not been previously water flooded, adequate pore space may still be provided in the reservoir by pumping the production well and injecting the gas until about 5 to 15 percent pore space is obtained within the reservoir. After obtaining an adequate pore volume the carbon dioxide injection followed by the water injection as described above may be utilized to accomplish the enhanced recovery of the oil from the reservoir. This procedure may not be necessary since the "dead" oil may be associated with a sufficient amount of gas in the reservoir.

A further feature of the present invention assures adequate mixing between the carbon dioxide liquid-vapor mixture and the oil in the reservoir. This mixing is achieved by reducing the pressure in the oil reservoir to a level in the range of about 100 to 200 psia below the saturated vapor pressure of carbon dioxide, terminating the pumping after reaching the desired pressure, and "shutting in" the production well. This procedure establishes a relatively small pressure gradient between the injection well 14 and the production well 16 to provide a longer time period for the carbon dioxide to mix with the oil than available if the production well were maintained in the pumping or draw-down state. This increased contact time afforded by the relatively steady-state condition greatly enhances the contact or mixing of the carbon dioxide vapor and the oil. After achieving a mixing equilibrium of the carbon dioxide vapor and the oil, water injection at the injection well may be resumed to provide fluid production at the production well.

It will appear clear that the method of the present invention provides a relatively simple method for enhanced oil recovery by carbon dioxide flooding in oil reservoirs where the oil-bearing strata is at a temperature less than 87.7° F. and where the injection pressure is greater than the saturated vapor pressure of carbon dioxide at that temperature. This unique feature of the present invention is believed to permit a substantial quantity of oil to be added to the reserves of this country so as to help ease the energy shortage this country is presently encountering.

What is claimed is:

1. An improvement in the method of recovering oil from subterranean oil-bearing strata by carbon dioxide flooding where the oil-bearing strata is at a temperature less than the critical temperature of carbon dioxide and at an injection pressure greater than the saturated vapor pressure of carbon dioxide at said temperature, comprising the steps of injecting liquid carbon dioxide into a first well penetrating the oil-bearing strata for displacing the oil from the oil-bearing strata to a second well penetrating the oil-bearing strata at a location in the oil-bearing strata separated from the first well, and thereafter and prior to the displacement of the oil from the oil-bearing strata by the carbon dioxide reducing the pore pressure in substantially all of the oil-bearing strata intermediate the first and second wells to a value less than the saturated vapor pressure of carbon dioxide at said temperature to vaporize carbon dioxide in said strata at locations spaced from the first well for facilitating the mixing of the carbon dioxide with the oil in the oil-bearing strata at said locations.

2. The improvement in the method of recovering oil from subterranean oil-bearing strata as claimed in claim 1, wherein said locations extend through said oil-bearing strata from an area adjacent the first well to the second well, and wherein the step of reducing the pore pressure in the strata intermediate first and second wells is achieved by sufficiently pumping the second well to reduce the pore pressure in the oil-bearing strata intermediate said wells to a pore pressure no greater than said value in said location.

3. The improvement in the method of recovering oil from subterranean oil-bearing strata as claimed in claim 2, including the additional step of injecting water into the first well after the step of injecting the carbon dioxide for displacing the carbon dioxide through said strata.

4. The improvement in the method of recovering oil from subterranean oil-bearing strata as claimed in claim 3, wherein the oil-bearing strata intermediate said wells contains at least one of a gas space and a void space in the range of 5 to 15 pore volume percent.

5. The improvement in the method of recovering oil from subterranean oil-bearing strata as claimed in claim 4, including the additional step of injecting a sufficient volume of gas into said injection well prior to the injection of the carbon dioxide to displace liquids from said strata to provide said pore volume in said range.

6. The improvement in the method of recovering oil from subterranean oil-bearing strata as claimed in claim 3, including additional step of terminating said pumping after effecting the reduction of the pore pressure to said value to decrease the pressure drop between said wells for promoting mixing of the carbon dioxide with oil in said oil-bearing strata.

7. The improvement in the method of recovering oil from subterrenean oil-bearing strata as claimed in claim 3 wherein the pore pressure in said strata is reduced to a value in the range of about 100 to 200 psi below the saturated vapor pressure of carbon dioxide at the temperature of the oil-bearing strata.

* * * * *